US006367099B1

(12) United States Patent
Contrino et al.

(10) Patent No.: US 6,367,099 B1
(45) Date of Patent: Apr. 9, 2002

(54) METHOD AND DEVICE FOR ASSEMBLING COMPONENTS FOR WATER RETENTION TANKS, SUCH AS SWIMMING POOLS FOR EXAMPLE

(75) Inventors: François Contrino; Michel Del'Immagine, both of Marseilles (FR)

(73) Assignees: Francois Contrino; Robert Nugel, both of Marseilles (FR)

( * ) Notice: Subject to any disclaimer, the term of this patent is extended or adjusted under 35 U.S.C. 154(b) by 0 days.

(21) Appl. No.: 09/786,343

(22) PCT Filed: Sep. 9, 1999

(86) PCT No.: PCT/FR99/02150

§ 371 Date: Mar. 9, 2001

§ 102(e) Date: Mar. 9, 2001

(87) PCT Pub. No.: WO00/15927

PCT Pub. Date: Mar. 23, 2000

(30) Foreign Application Priority Data

Sep. 10, 1998 (FR) ..... 98 11455

(51) Int. Cl.[7] ..... E04H 4/04
(52) U.S. Cl. ..... 4/506; 52/762; 220/681
(58) Field of Search ..... 4/506; 52/460, 52/584.1, 762, 763, 780; 220/681, 683

(56) References Cited

U.S. PATENT DOCUMENTS 1,723,307 A * 8/1929 Sipe ..... 52/762 X
3,080,022 A * 3/1963 Mote ..... 52/762 X
3,193,129 A * 7/1965 Pfluger et al. ..... 220/681 X
3,427,662 A 2/1969 Jacuzzi et al. ..... 452/169.7
3,975,874 A 8/1976 Witte et al. ..... 524/169.7
4,047,340 A 9/1977 Witte et al. ..... 52/169.7
5,896,715 A 4/1999 Maupas ..... 4/506 X

FOREIGN PATENT DOCUMENTS

| | | |
|---|---|---|
| AU | 55444/73 | 5/1972 |
| EP | 0799952 | 10/1997 |
| FR | 02726527 | 5/1996 |
| WO | 91/09192 | 6/1991 |

* cited by examiner

*Primary Examiner*—Robert M. Fetsuga
(74) *Attorney, Agent, or Firm*—Greenblum & Bernstein, P.L.C.

(57) ABSTRACT

The invention concerns a method for assembling components for water retention tanks, such as swimming pools for example, characterised in that it consists in: producing parts or elements of the pool or shell (1) with one edge (7) oriented outwards, over at least part of their periphery, and outer structural elements **(2, 3*a*, 3*b*, 4) with a groove (8) oriented inwards; providing a sealing joint (9) at the bottom of said groove; and engaging therein the adjacent outer edges (7) of two contiguous shell elements (1), such that they are urged to rest on said joint (9), under the pressure of water introduced in the pool thereby assembling the set of shell (1) elements, and thus producing the junction of said shell (1)** parts or elements and sealing said junction.

12 Claims, 5 Drawing Sheets

Fig.5
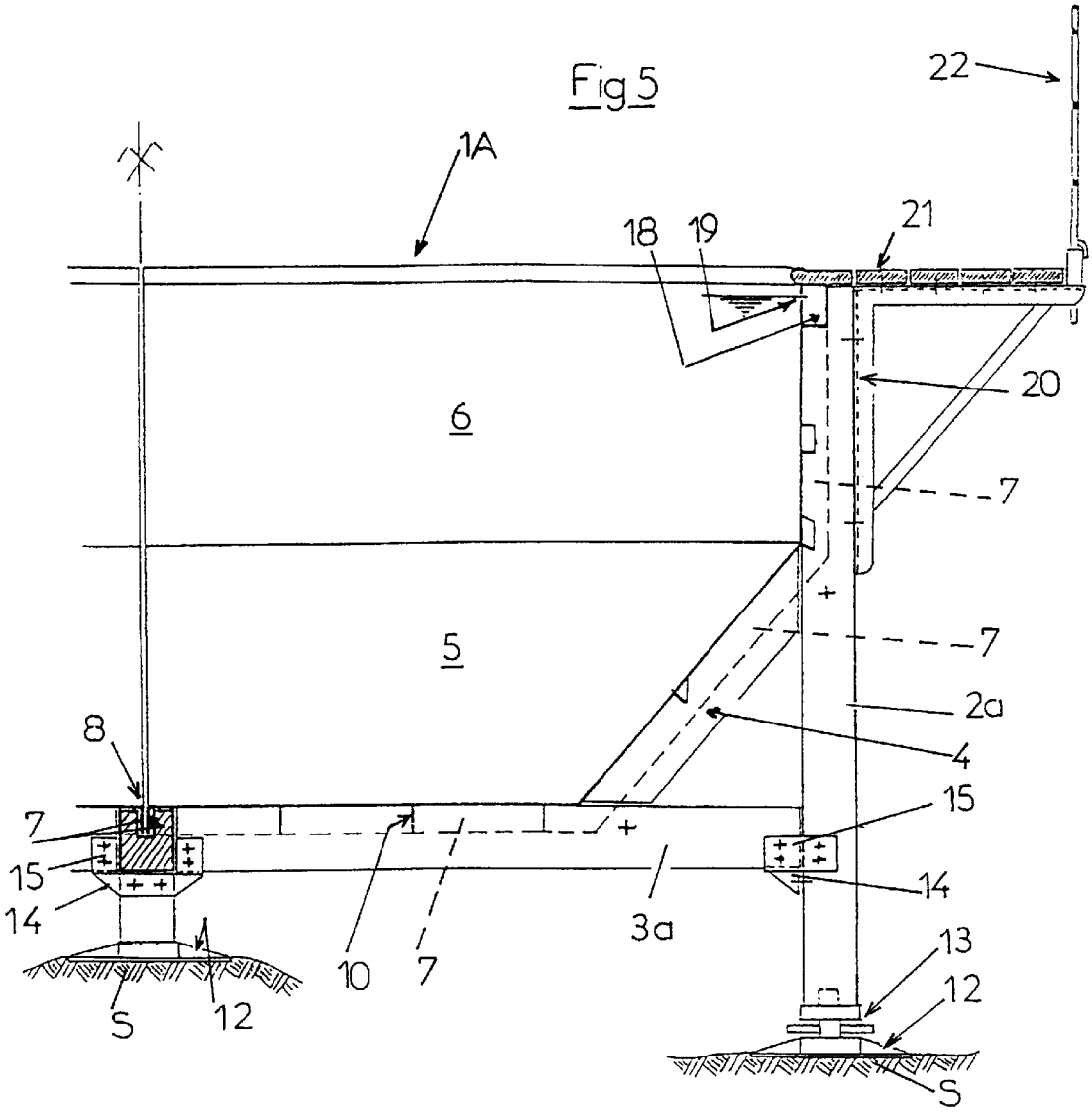
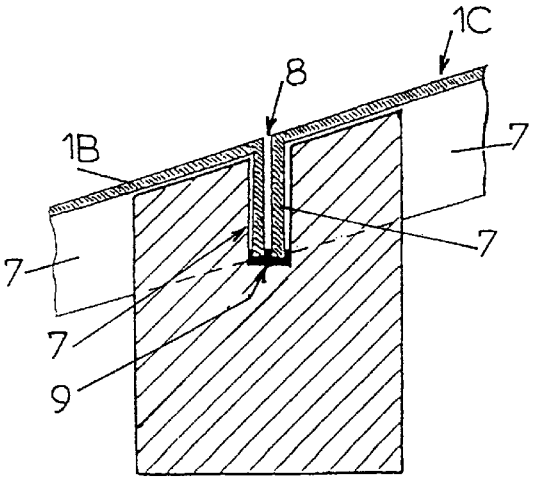
Fig.6
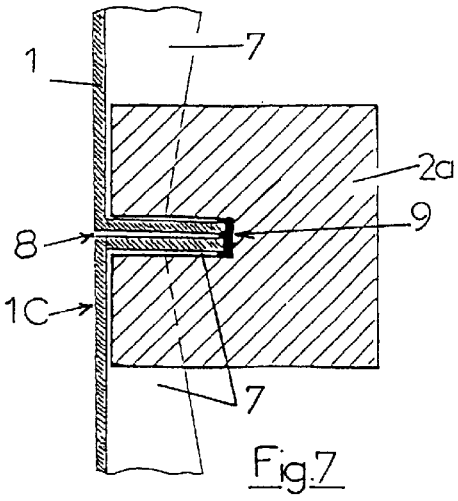
Fig.7

METHOD AND DEVICE FOR ASSEMBLING COMPONENTS FOR WATER RETENTION TANKS, SUCH AS SWIMMING POOLS FOR EXAMPLE

The present invention relates to a method and device for assembling prefabricated components of water retention tanks, such as swimming tanks or swimming pools, for example. It also concerns the water retention tanks such as swimming pools resulting from the implementation of this assembling method and device.

Up until now, numerous methods and systems have been proposed for obtaining underground, semi-underground or above-ground swimming pools, dismountable or not, using prefabricated elements assembled by means of various connecting devices.

For example, the document FR-2 726 527 describes a dismountable swimming pool constituted of a plurality of elements molded by a rotomolding process and assembled by means of bolts and sealing joints through which the shafts of said bolts extend. To avoid injuries, a shoot covers the assembling ribs and the fixing means.

In particular, the disadvantages of such a construction are:

- the need to have a completely planar receiving surface, or to prepare such a surface prior to mounting the tank;
- the necessity to use a large number of assembly members (threaded shafts and nuts) and adequate tools for tightening them;
- a relatively long assembling time;
- the difficulty in dismounting, which can result in the corrosion of the assembly members due to their prolonged immersion in water;
- the presence of dangerous protuberances in the swimming pool.

The document EP-0 799 952A describes a system for assembling prefabricated panels to form a swimming pool wall, according to which each panel is constituted by a plate, the two opposite vertical edges of which are folded to the same side of the panel to form flanges; the assembly of these panels is carried out by means of two rectilinear section members, i.e., a first section member having a C-shaped right cross-section, which is adapted to be fitted over the adjacent flanges of the two contiguous panels, and a second section member that is adapted to be engaged inside the first section member and between the two adjacent flanges of these two panels, and stiffening means for locking the two flanges into position between the two section members.

Such a method for assembling a swimming pool wall is very difficult to implement. Indeed, the assembly elements which are to be positioned by longitudinal sliding and which are to operate by wedging effect must be force fitted by means of a mallet or other tool.

For the same reasons, dismounting a wall obtained in this way is at least extremely difficult, if not impossible. Furthermore, the strength of such an assembly is very uncertain, such that the document EP-0 799 952 provides a stiffening of the wall by means of reinforcing struts.

Finally, the aforementioned document provides the use of a flexible container or liner to form the bottom and the waterproof covering of the vertical walls of the swimming pool, which requires having a container made specifically for this purpose, which is subject to tear and wear, difficult to put in place, and which requires preparing a rigorously flat terrain.

The document WO 91/09192 describes a swimming pool assembled above the ground, which includes:

- an annular framework generally constituted of a base member, a set of spaced apart upright elements or posts set in the base member and topped by a peripheral coping that sits on top of the posts;
- a vertical wall made of a sheet metal that extends throughout the internal periphery of the annular framework;
- a flexible container to form the bottom and a waterproof lining of the peripheral wall.

The annular framework is constituted of complex elements, and the various constituent parts of the swimming pool are difficult to position and assemble. Moreover, it can be assembled only on a rigorously flat terrain, which requires having such a flat terrain, or preparing such a terrain prior to the assembly. Furthermore, the work described in the document WO 91/09 192 has the aforementioned disadvantages of the water retention tanks obtained by means of a container.

Another system is known (AU-55444/73 A) for assembling panels comprising an edge oriented outward, this system including elongated members for joining these panels, having a longitudinal slit in which the adjacent outer edges of the two contiguous panels are engaged. The author of the aforementioned document envisioned a plurality of possible applications of this assembling system, including, "in fine," the assembly of swimming pools, without specifying, however, whether this is directed to underground, semi-underground, or above-ground swimming pools; however, one can assume, in this case, that this a mere theoretical application, in view of the fact that the joining of the panels by means of mere clipping elements would not make it possible to obtain an adequate sealing, whether this involves underground, semi-underground, or above-ground swimming pools. Moreover, in the application to above-ground swimming pools, this panel joining method would not resist the substantial pressing forces exerted perpendicular to the panels and also parallel to the latter, if one considers that the vertical walls constitute a closed enclosure. Filling a swimming pool with water to according to the assembling method described in the document AU-55444/73-A would inevitably cause the latter to burst.

The invention proposes to overcome the disadvantages and deficiencies of the water retention tanks, such as the dismountable swimming pools adapted to be assembled above the ground, for example.

According to the invention, this object is achieved due to a method and device for assembling constituent elements of a water retention tank, such as a swimming pool, disclosed in independent claims 1 and 2, respectively.

Due to the characteristics arrangement of the device and the method of the invention, it is possible to quickly install water retention tanks such as private or public swimming pools by means of simple and robust elements, without using assembling members such as bolts or the like, the assembly being capable of being carried out easily, without any tool, by only two people. In fact, strictly speaking, the shell elements are not assembled to one another, but are merely juxtaposed.

Another important advantage of the method and device of the invention is that the imperviousness of the shell is obtained by the weight of the shell elements and, in particular, by the water pressure on the inner surface of said shell elements, under the effect of which the sealing joint housed in the structural elements is compressed, the structural elements constituting the joining elements of the shell elements making it possible to resist the pressing forces exerted by water both in the perpendicular direction with respect to said shell elements and in the parallel directions with respect thereto.

The device and the method according to the invention make it possible to obtain permanent or seasonal water retention tanks; they make it possible to avoid using extensive and specialized external means for installing such tanks, and to easily and quickly disassemble them, for example for winter. The various constituent elements of the disassembled swimming pools can be stored in a compact storage space.

Furthermore, this device and this method do not impose any particular shape and dimensions for the tank, such that in the application to the manufacture of swimming pools, in particular, various pool shapes and dimensions can be envisioned.

According to another very important characteristic arrangement of the invention, the carrying framework or structure includes pillars or posts arranged so as to rest on the ground, and crossbeams, these posts and crossbeams being dimensioned and arranged such that after the assembly, the bottom of the water retention tank is positioned, after mounting, above and at a distance from the ground, with the possibility to recover the terrains in their initial state, or substantially in their initial state, after disassembly of the tanks.

Due to this arrangement, it is possible to assemble swimming pools having a variable depth.

According to another characteristic arrangement, the vertical posts or carriers are equipped with length adjusting means, and/or wedging means making it possible to adjust with great precision the horizontal positioning of the surface recovery shoots with which the upper edge of the tanks can be equipped.

Due to this arrangement, the water retention tanks can be mounted on terrains that are planar or hilly, flat or inclined, in natural state or grass-covered.

The aforementioned objects, characteristics and advantages, and still others, will become more apparent from the following description, and the annexed drawings in which:

FIG. 5 is a half cross-sectional view, on a larger scale, along the line C—C of FIG. 3.

FIG. 6 is a detailed cross-sectional view, on a larger scale, along the line D—D of FIG. 3.

FIG. 7 is a detailed cross-sectional view, on a larger scale, along the line E—E of FIG. 2.

Figure 1:
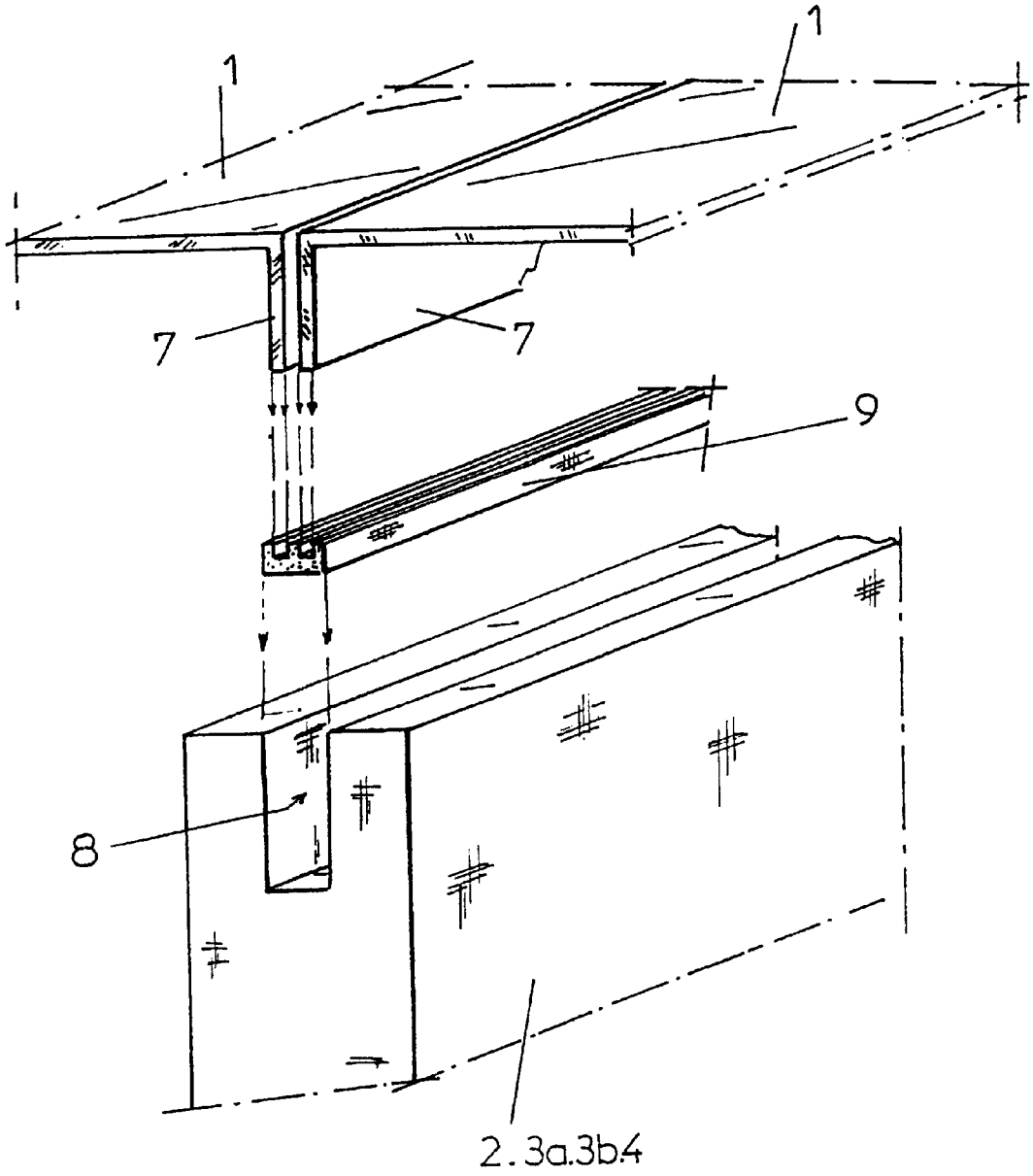
FIG. 1 is an exploded perspective view showing the method and device for the waterproof assembly of constituent elements of water retention tanks according to the invention.

Reference is made to said drawings to describe an interesting, albeit non-limiting example of embodiment of the method and of the device for assembling constituent elements of the water retention tanks, according to the invention.

Generally speaking, the invention relates to a water retention tank which can be assigned various uses (water tank for fire hydrants, drinking trough, aquaculture tanks, etc.), but a particularly interesting application is the obtaining of dismountable swimming pools to which particular reference is made in the following description.

The swimming pool according to the invention is mainly composed of:

a shell constituted of a plurality of shell parts or elements 1; and an outer carrying framework or structure constituted of a plurality of structural elements including, for example, pillars 2, horizontal crossbeams 3*a*, and, advantageously sloping crossbeams 3*b*, and struts 4, these three kinds of elements being capable of being made individually and detachably connected, by means of adequate assembling members, or, in certain cases, obtained in a single piece.

According to the example shown, the swimming pool is constituted of two alignments of five elements 1A, 1B, 1C, 1D, 1E, arranged on both sides of its longitudinal axis; in this case, all of the shell elements are peripheral elements.

By way of example, a swimming pool of this type can be 10 m long, 5 m wide, and can have a depth that can vary from 1 m to 2 m.

The peripheral elements include a bottom portion 5 and a lateral wall portion 6 and can be made of any rigid plastic material and by any suitable molding process.

According to a first characteristic arrangement of the invention, the shell parts or elements 1 comprise, over at least a portion of their periphery, an edge 7 oriented toward the outside of the shell, whereas the structural elements 2, 3*a*, 3*b*, 4, are provided, in their surface adapted to be oriented toward the inside of the shell, with a groove 8 at the bottom of which a sealing joint 9 is preferably and advantageously housed, and said shell elements 1 are assembled by joining their edges 7 side by side and by engaging the adjacent edges of the contiguous shell elements in the groove 8 of said structural elements 2, 3*a*, 3*b*, 4.

The grooves 8 advantageously have a width that is equal to at least twice the thickness of the edges 7, such that two adjacent edges can be engaged and housed with no noticeable play in said grooves. Furthermore, the edges 7 have a width that is barely less than the depth of the grooves 8, such that when the shell elements are in place, the free edge of said edges rests on the joints 9 by compressing them, whereas the outer surface of the shell elements 1 is in support against the inner surface of the structural elements 2, 3*a*, 3*b*, 4.

The joints 9 can be made of any suitable rubbers or other elastomers. The shell elements 1 are preferably provided with stiffeners constituted by ribs 10 with which the outer surfaces of said shell elements are provided. In this case, the structural elements 2, 3, 4*a*, 4*b* comprise transverse notches 11, on their surface oriented outward, for nesting said ribs.

An advantages of the swimming pools according to the invention is that they can have a variable depth from one end to the other.

Figure 2:
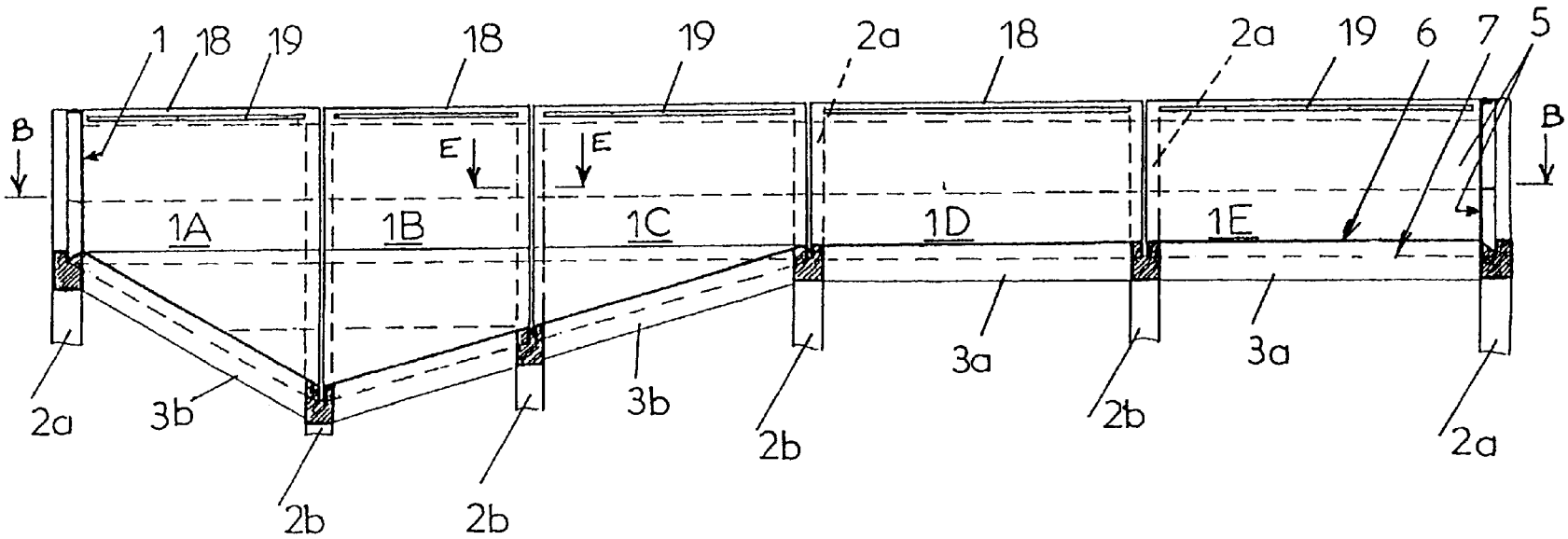
FIG. 2 is a longitudinal cross-sectional view of a swimming pool obtained according to the invention, considered along the line A—A of FIG. 3.
Figure 3:
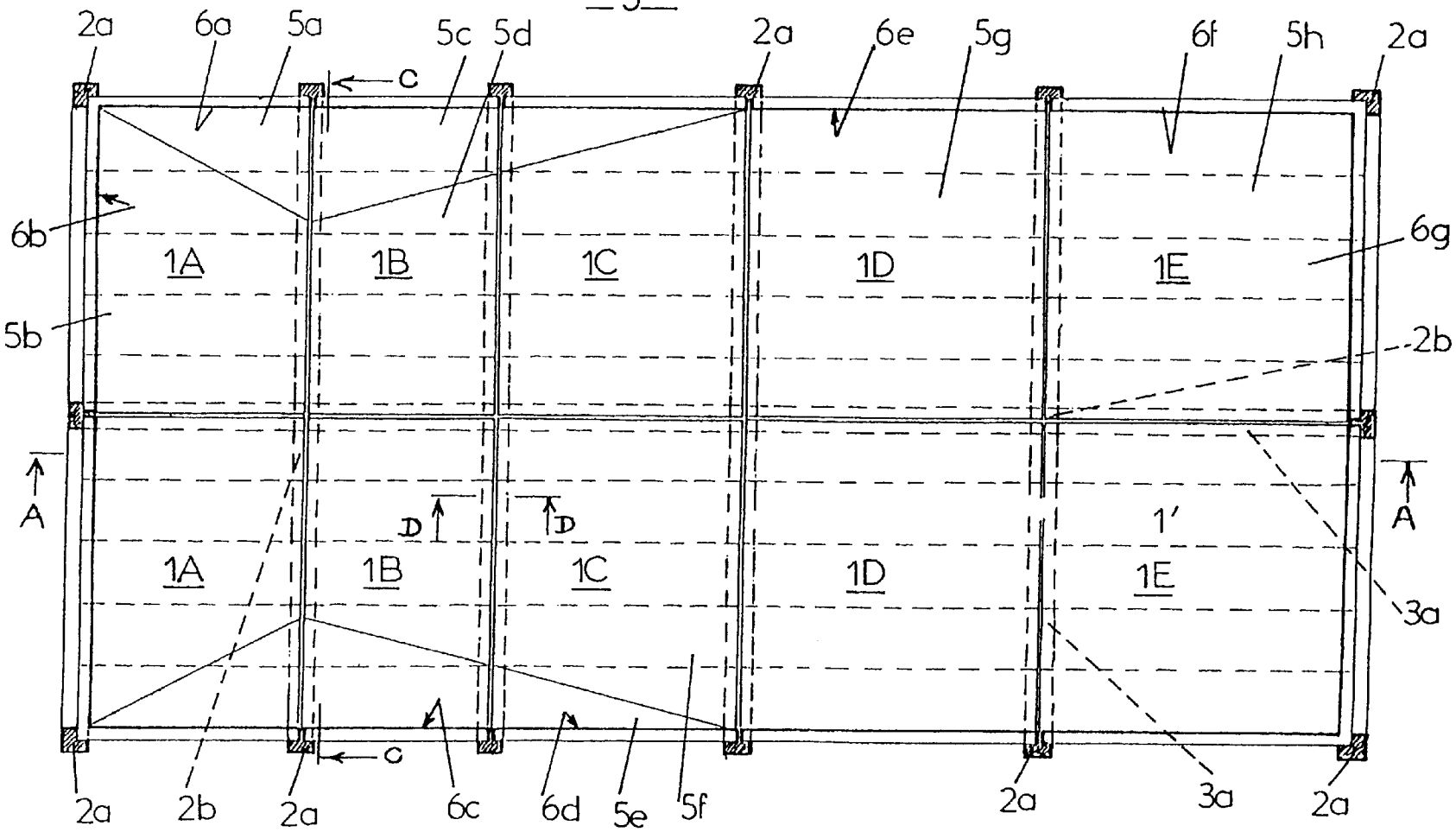
FIG. 3 is a planar and cross-sectional view of this pool along the line B—B of FIG. 2.

According to the embodiment shown in FIGS. 2 and 3, only by way of example, the shell of the swimming pool is constituted of the following shell elements, on both sides of its longitudinal axis, and from its left end to its right end:

a corner shell element 1A comprising two vertical, perpendicular wall portions 6*a*, 6*b* and two bottom portions 5*a*, 5*b* forming an obtuse angle with said lateral walls and also with one another;

a first lateral shell element 1B including a vertical wall portion 6*c* and two inclined bottom portions 5*c*, 5*d*, the first bottom portion 5*c* being connected to the vertical wall 6*c* by forming an obtuse angle with the latter, whereas the second bottom portion 5*d* is connected to the first with which it also forms an obtuse angle; the inclined walls 5*b*, 5*d* of the shell elements 1A, 1B form an obtuse angle therebetween.

a second intermediate lateral shell element 1C including a vertical wall portion 6*d* and two inclined bottom portions 5*e*, 5*f*, the first of these bottom portions being connected to the vertical wall 6*d* by forming an obtuse angle with the latter, whereas the second is connected to the first with which it also forms an obtuse angle; the inclined walls 5*d*, 5*f* of the shell elements 1B, 1C, are arranged in the same oblique plane; the bottom portions of the shell elements 1A, 1B, 1C constitute a pit whose bottommost point corresponds to the junction line of the inclined bottom portions 5*b*, 5*d* of the shell elements 1A, 1B, respectively;

a third intermediate lateral shell element 1D including a vertical, lateral wall portion 6*e* and a horizontal bottom portion 5*g;* a corner element 1E including two vertical, lateral wall portions 6*f*, 6*g* arranged perpendicularly, and a horizontal bottom portion 5*h* connected to the base of said lateral wall portions.

According to this embodiment, the bottom portions 5*a*–5*b*, 5*c*–5*d*, 5*e*–5*f*, of the shell elements 1A, 1B, 1C, respectively, extend beneath the level at which the bottom walls 5*g*, 5*h* of the shell elements 1D, 1E, respectively, are located, such that the shell constituting the swimming pool or other water retention tank, has a variable depth, from one end to the other of said swimming pool or tank.

Figure 4:
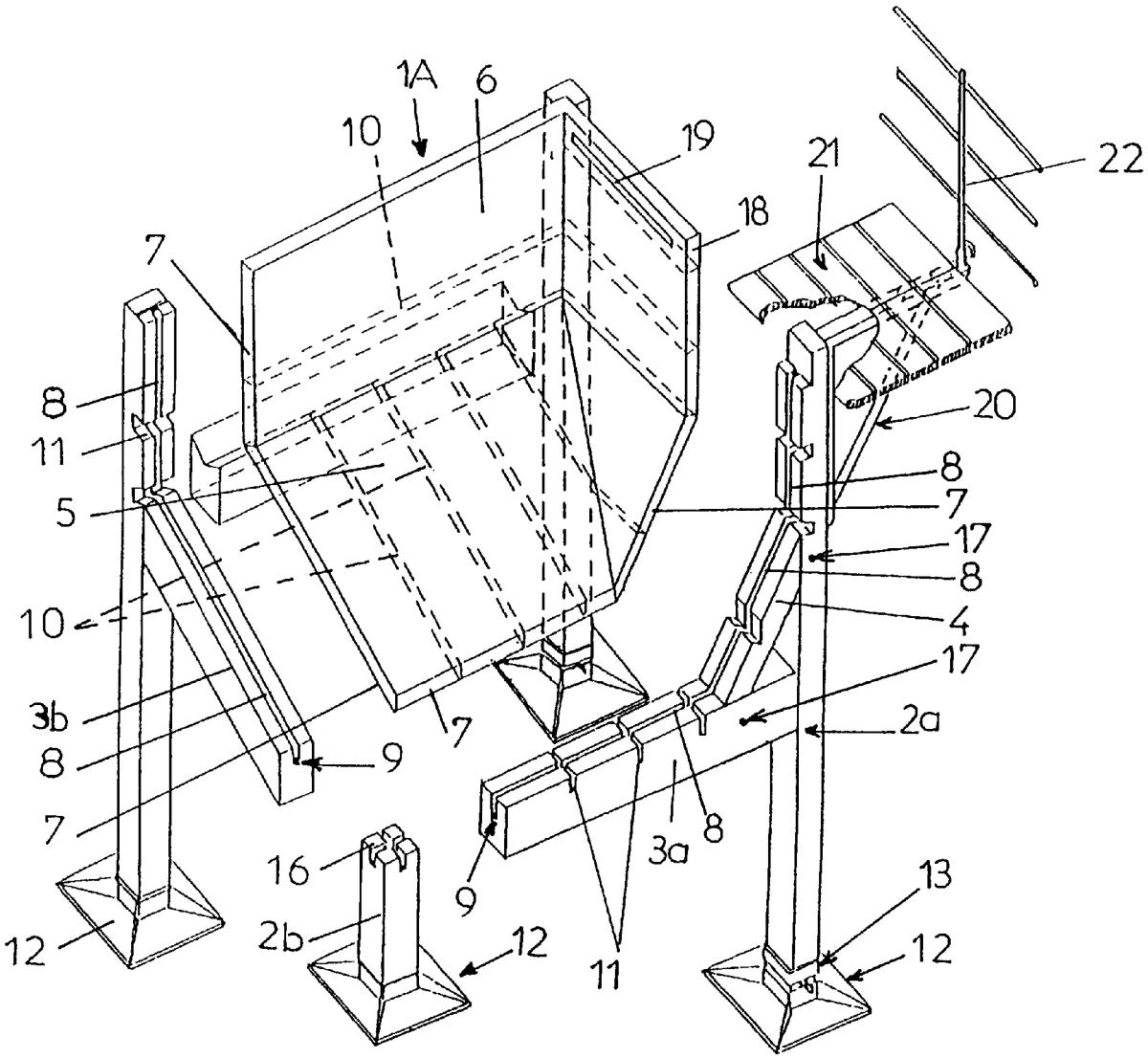
FIG. 4 is an exploded perspective view of one of the corners of the pool.

As indicated previously, the structural elements include pillars 2 and horizontal crossbeams 3*a*. Furthermore, in view of the fact that one of the objects of the invention is the possibility to obtain swimming pools having a variable depth, the pillars can have different heights depending on their location in the assembly of the carrying structure, and the structural elements also include sloping crossbeams 3*b* and struts 4 adapted to support the inclined portions of the bottom wall of the shell. Thus, as shown in FIG. 4, the pillars 2 include pillars 2*a* arranged at the periphery and outside the shell 1, on the one hand, and pillars 2*b* positioned within the area demarcated by the periphery of the shell and beneath the latter, on the other hand. The pillars 2*a* arranged at the periphery of the shell have a height determined so as to rise up to the upper edge of the shell 1, and the base of the latter is positioned at a distance from the ground. Furthermore, the pillars 2*b* arranged within the area demarcated by the shell surface, have a much more reduced height, which varies as a function of the configuration of the bottom of the latter, and of the location of said pillars.

The vertical pillars or carriers 2 can be equipped with length adjustment means.

The pillars 2 are advantageously provided with stands 12 constituted, for example, by a metallic base, and at least some of them being preferably provided with a screw lifting jack 13 or other wedging device making it possible to adjust, with great precision, the horizontal positioning or the slight inclination of the upper edges of the tank, as indicated in the following disclosure.

The horizontal crossbeams 3*a* are placed on post brackets 14 fixed on the pillars 2 and positioned between flanges 15.

As shown in FIG. 4, the top of the pillars 2*b* adapted to be positioned beneath the shell, comprises two perpendicular notches or slits 16 for inserting the edges of the corners of four juxtaposed shell elements.

The sloping crossbeams 3*b* and the struts 4 have varied lengths depending on their location beneath the shell. For example, the struts 4 are fixed to the pillars 2*a* and their crossbeams 3 via their opposite ends and by means of pins 17 or other adequate assembling members.

In this way, one obtains a triangulation of the elements 2*a*, 3*a*, and 4 of the carrying structure that opposes the horizontal thrust of the water.

The pillars 2, the crossbeams 3*a*, the sloping crossbeams 3*b*, and the struts 4 can be made of stainless steel or aluminum, or preferably of improved wood such as wood core plywood, which is widely used in the building trade for making lightweight, non-deformable and extremely resistant carrying elements.

The vertical walls of at least some of the peripheral shell elements 1 are ended, in their upper portion, by a hollow section 18 having a rectangular cross-section, for example, this hollow section forming a longitudinal shoot and overflow-shoot; to this end, it comprises a longitudinal slit 19 in its inner wall. The surface recovery shoots 18 are configured or arranged such that their bottom is slightly inclined so as to enable a recycling of the water by skimming the water plane surface, The screw lifting jacks 13 or other adjusting systems, with which the stands 12 of the pillars 2*a* are equipped, enable a vertical fine wedging of the latter, so that skimming by the surface recovery shoots 18 is complete on the entire water plane surface.

Post brackets 20, on which a rigid horizontal structure 21 is fixed, are fixed on the upper portion of the pillars arranged outside and at the periphery of the shell, preferably in a removable manner, by means of any suitable assembling members (pins, bolts, etc.).

This flat structure can be constituted directly by elements such as floor elements adapted to form a platform, or configured to receive slabs of an appropriate material adapted to constitute this platform surrounding the upper portion of the shell.

The peripheral range 21 thus obtained forms a belt that surrounds the top portion of the work and contributes to ensuring that it does not deform.

A guard railing 22 is removably mounted along the outer edge of the peripheral platform 21.

A very advantageous application of the invention to making above-ground swimming pools has been described previously; however, it is obvious that the invention can also be implemented for making underground and semi-underground swimming pools or water retention tanks. In this case, the outer structural elements are not necessarily carrying elements, and the elements of said outer framework can be without stands.

What is claimed is:

1. A method of assembling constituent elements of water retention tanks, according to which parts or elements of the tank or shell are made with an edge oriented outward, over at least a portion of their periphery, and joining elements of these shell parts or elements, with a groove oriented inward, and the adjacent outer edges of two contiguous shell elements are engaged therein, wherein one uses, as joining elements, structural elements of a carrying framework or structure outside the tank, provided with the groove whose width is equal to at least twice the thickness of said edge and at the bottom of which a sealing joint is arranged, so that the adjacent outer edges of the two contiguous shell elements are urged to rest on said joint, under the pressure of water introduced in the tank resulting from the assembly of the sets of shell elements, thus obtaining the junction of said shell parts or elements and sealing this junction.

2. A water retention tank comprising:

a shell constituted of a plurality of shell parts or elements comprising, over at least a portion of their periphery, an edge oriented outward;

joining elements of these shell parts or elements, these joining elements being provided with a groove in their surface adapted to be oriented inward of the shell;

wherein the joining element are constituted by structural elements of a carrying framework or structure outside the tank provided with a groove at the bottom of which a sealing joint is housed, the width of this groove being equal to at least twice the thickness of said edge, such that the adjacent edges of two contiguous shell elements can be engaged in said groove and be urged to compress the sealing joint, thereby obtaining the assembly of said shell elements and sealing this junction.

3. An assembly method according to claim 1, wherein the support and assembly of the corners of the shell elements arranged within the perimeter of the latter, are obtained by means of pillars comprising, at their top, perpendicular notches in which the edges of the corners of four juxtaposed shell elements are engaged.

4. An assembly device according to claim 2, wherein the device comprises pillars having a top portion provided with two perpendicular notches in which the edges of the corners of four juxtaposed shell elements are engaged.

5. A water retention tank, wherein the tank is made by implementing the method according to claim 1.

6. A water retention tank, wherein the tank is made by means of the assembly device according to claim 2.

7. A water retention tank, according to claim 5, wherein the outer structural elements include pillars arranged outside the shell and crossbeams arranged beneath the latter which is thus installed above and at a distance form the ground.

8. A water retention tank, according to claim 5, wherein the bottom walls of the shell elements of a portion of the tank, extend beneath a level at which are located the bottom walls of the shell elements of the remaining portion of said tank, such that the latter has a variable depth, from one end to the other.

9. A water retention tank, according to claim 7, wherein the tank comprises struts connecting the outer pillars and horizontal crossbeams, so as to obtain a triangulation that opposes the horizontal thrust of the water.

10. A water retention tank, according to claim 5, wherein at least certain pillars of the carrying structure are provided with an adjustable stand.

11. A water retention tank, according to claim 5, wherein the top of the vertical walls of at least certain peripheral shell elements is provided with at least one longitudinal surface recovery shoot provided with a longitudinal skimming slit.

12. A water retention tank, according to claim 5, wherein the tank comprises a peripheral platform surrounding the upper portion of the shell, after the mounting thereof, so as to form a belt surrounding the top portion of the work.

* * * * *

UNITED STATES PATENT AND TRADEMARK OFFICE

CERTIFICATE OF CORRECTION

PATENT NO. : 6,367,099 B1
DATED : April 9, 2002
INVENTOR(S) : F. Contrino et al.

It is certified that error appears in the above-identified patent and that said Letters Patent is hereby corrected as shown below:

Title page,
Item [73], Assignees, "Francois Contrino; Robert Nugel," should read
-- François Contrino; Robert Hugel, --.

Signed and Sealed this

Sixteenth Day of July, 2002

*Attest:*

*Attesting Officer*

JAMES E. ROGAN
*Director of the United States Patent and Trademark Office*